US006244434B1

(12) United States Patent
Brooks

(10) Patent No.: US 6,244,434 B1
(45) Date of Patent: Jun. 12, 2001

(54) TOBACCO COMBINATION PACK

(76) Inventor: William Brooks, 35W337 Riverside Dr., St. Charles, IL (US) 60174

( * ) Notice: Subject to any disclaimer, the term of this patent is extended or adjusted under 35 U.S.C. 154(b) by 0 days.

(21) Appl. No.: 09/399,666

(22) Filed: Sep. 21, 1999

Related U.S. Application Data

(63) Continuation-in-part of application No. 09/286,049, filed on Apr. 5, 1999, now Pat. No. 6,026,952.

(51) Int. Cl.[7] ..... B65D 77/00
(52) U.S. Cl. ..... 206/236; 206/216
(58) Field of Search ..... 206/85–95, 236–242, 206/256, 216, 217, 541, 542; 215/6; 426/106, 120

(56) References Cited

U.S. PATENT DOCUMENTS 1,790,360 * 1/1931 Wiederseim ..... 206/236
1,920,193 * 8/1933 Gary ..... 206/236
2,011,399 * 8/1935 Driscoll ..... 206/236
2,506,385 * 5/1950 Roamer ..... 206/236
3,763,996 * 10/1973 Shepherd ..... 206/85
4,308,952 * 1/1982 Paulucci ..... 206/216
5,031,645 * 7/1991 Kim ..... 206/236
5,372,827 * 12/1994 Brauner et al. ..... 426/106
5,664,671 * 9/1997 Nedblake, Jr. ..... 206/217
5,881,868 * 3/1999 Soyak et al. ..... 206/256
5,901,710 * 5/1999 Barber ..... 206/242

* cited by examiner

*Primary Examiner*—Jim Foster
(74) *Attorney, Agent, or Firm*—Wood, Phillips, VanSanten, Clark & Mortimer

(57) ABSTRACT

A tobacco combination pack is provided including a tobacco product and an article related to, and separate from, the tobacco product. The tobacco product and related article are packaged together in a first container and sold as a single item.

5 Claims, 2 Drawing Sheets

TOBACCO COMBINATION PACK

CROSS-REFERENCE TO RELATED APPLICATION

This application is a continuation-in-part of U.S. application Ser. No. 09/286,049 to Brooks filed Apr. 5, 1999 and entitled "Liquor and Cigar Combination Pack" U.S. Pat. No. 6,026,952.

FIELD OF THE INVENTION

The present invention is directed toward a tobacco combination pack and, more particularly, toward a cigar combination pack including at least one cigar and an associated article.

BACKGROUND OF THE INVENTION

Cigar smoking is becoming a popular past time, typically among the male population. Generally, in association with enjoying a fine cigar, one will also enjoy his/her favorite beverage, preferably an alcoholic beverage. Thus, many taverns and other establishments selling liquor also provide for sale to their patrons an assortment of cigars, sold entirely separately from the liquor, in various flavors and sizes.

Cigars may generally be purchased one at a time or in boxes, with approximately 20–50 cigars to a box. Liquor is typically purchased, aside from individual drinks purchased at a tavern or restaurant (so-called "on sale" liquor sales), at a liquor store in quantities ranging from pints, to fifths, to liters (so-called "off sale" liquor sales). Thus, a person wishing to enjoy a cigar with a certain type of alcoholic beverage must first purchase a particular cigar(s), and then possibly travel to a different location, assuming they are not at a location selling both cigars and liquor, and purchase a quantity of the alcoholic beverage of their choice. Further, a person desiring to purchase a gift for an avid cigar smoker must purchase the cigar and the liquor separately. In this case, since the liquor will most likely be purchased at a liquor store, the purchaser may be required to travel to different locations to purchase both items. Still further, a purchaser of these items may purchase either too many cigars or too much liquor, resulting in wasted money.

For persons who do not drink alcoholic beverages, purchasing liquor to enjoy with a cigar is not a concern. For persons desiring to purchase a gift for an avid cigar smoker who does not consume alcoholic beverages, generally the only option is to purchase cigars only. A gift purchaser wishing to purchase an additional item with the cigar(s) must do so separately, possibly requiring traveling to a different location to purchase the additional item. A person may also have trouble deciding which additional item to purchase.

Also, once a cigar is smoked, it, along with the band, wrapper, etc., is generally discarded. While a person may remember specifically enjoying a cigar on a certain occasion, he/she may not be able to remember the name or brand of the cigar. This particularly becomes a problem where only a small number of cigars are purchased at a time.

The present invention is directed toward overcoming one or more of the above-mentioned problems.

SUMMARY OF THE INVENTION

A tobacco combination pack is provided including a tobacco product and an article related to, and separate from, the tobacco product. The tobacco product and related article are packaged together in a first container and sold as a single item.

In one form, the tobacco product includes at least one cigar or cigarette.

The cigar or cigarette may be contained in an airtight container separate from and within the first container.

In another form, the related article includes indicia associating the related article to the tobacco product. The indicia may include the name or the identifying trademark of the manufacturer of the tobacco product.

In yet another form, the tobacco product is marketed under a select marketing theme, and the related article is associated with the select marketing theme.

The related article may be virtually any type of article, novelty item or otherwise, and may include, but is not limited to, such items as golf balls, key chains, writing instruments (pens, pencils, etc.), cigar cutters, lighters, etc.

It is an object of the present invention to provide a convenient packaging arrangement featuring tobacco products and articles related thereto.

Other aspects, objects and advantages of the present invention can be obtained from a study of the application, the drawings, and the appended claims.

DETAILED DESCRIPTION OF THE INVENTION

Figure 1:
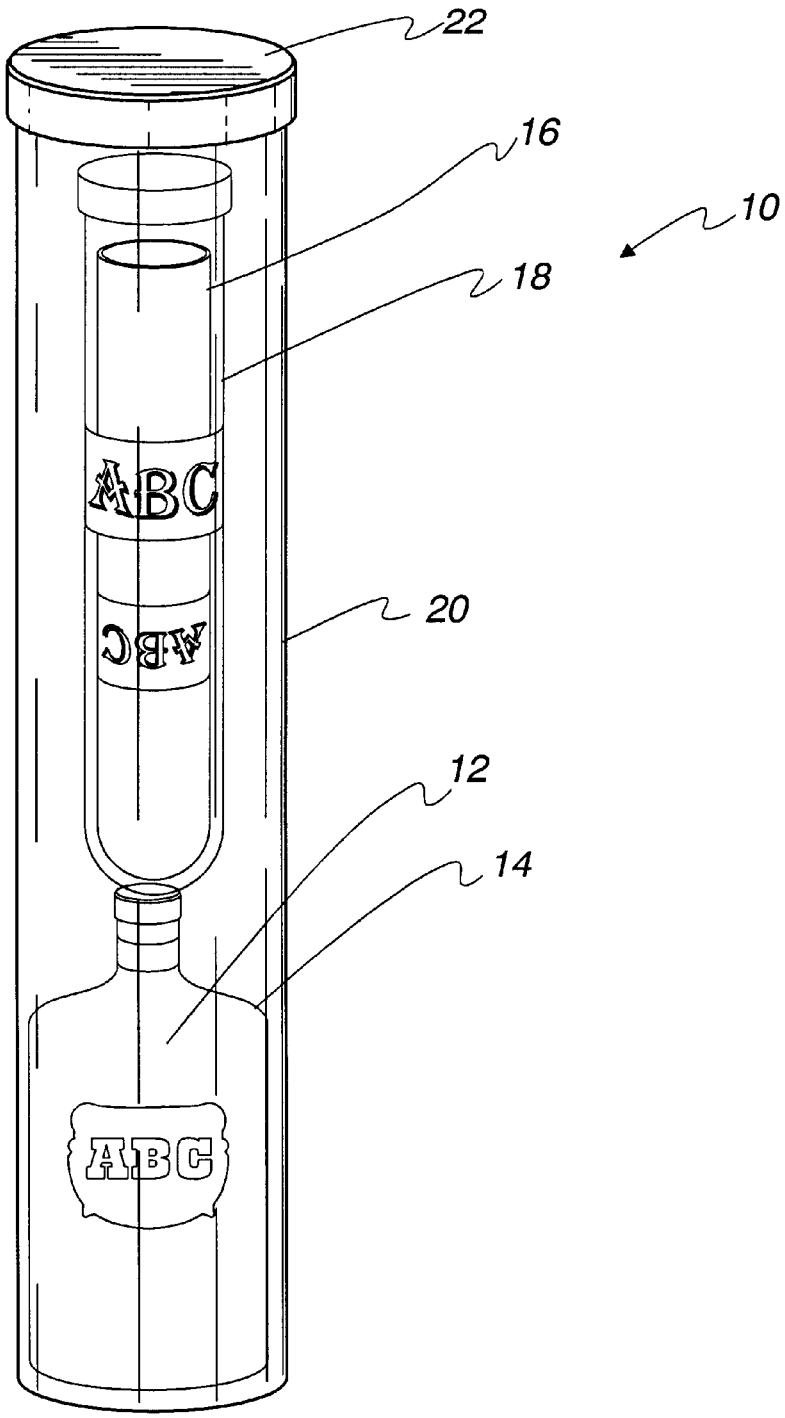
FIG. 1 is a front view of a tobacco combination pack according to a first embodiment of the present invention.

FIG. 1 illustrates a combination package arrangement according to a first embodiment of the present invention, shown generally at 10. The combination package 10 includes a preselect amount of a beverage 12 provided in a first or beverage container 14. In a preferred form, the beverage 12 is an alcoholic beverage, such as liquor, e.g., brandy, bourbon, cognac, whiskey, gin, rum, vodka, etc. However, virtually any type of beverage, both alcoholic and non-alcoholic, may be implemented with the present invention without departing from the spirit and scope thereof. The beverage container 14 may be a bottle, or other container, with approximately 20–100 mL of the beverage 12 provided therein. A 50 mL bottle of liquor is the preferred choice. In one embodiment a conventional "miniature" is employed.

The combination package 10 also includes at least one cigar 16, provided in an airtight second or tobacco container 18. Virtually any size cigar 16 may be implemented with the tobacco container 18 sized to fit the cigar 16. The containers 14 (including the beverage 12) and 18 (including the cigar 16) are packaged together in a third container 20 which is separate from either of the beverage or tobacco containers 14 and 18. The third container 20 is preferably a clear cylindrical plastic container approximately 12"–14" in length and approximately 1–¼" to 1–¾" in diameter, and having a lid 22 which may be either snap fit or twist off.

As shown in FIG. 1, the beverage container 14 and cigar container 18 are stacked one on top of each other to fit end to end inside the container 20, which is sized accordingly. However, any packaging arrangement, side-by-side, etc., in any type of third container 20, size or material, may be implemented without departing from the spirit and scope of the present invention. For example, the cylindrical third container 20 illustrated in FIG. 1 may be replaced by a box-type container, shrinkwrap material enclosing the items, etc. Further, the container 20 need not be transparent. In some cases, the second container 18 may be sized to receive both the cigar 16 and the first container 14 and then sealed. In this case, the third container 20 may be eliminated entirely.

To preserve the freshness of the cigar 16, the container 18 is preferably airtight. Virtually any type of cigar 16 may be packaged with virtually any type of beverage 12. For example, a Speakeasy™ brand cigar may be provided with any type of liquor, e.g., brandy, bourbon, cognac, whiskey, gin, rum, vodka, etc. However, in a preferred form, both the cigar 16 and the beverage 12 are related. As shown in FIG. 1, both the cigar 16 and the beverage 12 are of the same brand, e.g., "ABC" brand. However, the cigar 16 may be a private label cigar made for the beverage manufacturer whose beverage is included in the packaging arrangement 10. In any event, the cigar 16 and containers 18 and 14 would preferably include the same labels, with the container 18 preferably having an appearance somewhat similar to the appearance of the bottle 14. However, the cigar 16 may be totally unrelated to the beverage 12, e.g., made by different companies or sold under different brands.

Further, the cigar 16 may be related to the beverage 12 such that during manufacture the cigar 16 is soaked in the beverage 12, relating the flavor of the cigar 16 to that of the beverage 12. For example, if the beverage 12 consisted of ABC bourbon, the cigar 16 may be of the type that is soaked in ABC bourbon.

While FIG. 1 illustrates a cigar 16 packaged with the beverage 12, other tobacco products may be substituted in place of the cigar 16 without departing from the spirit and scope of the present invention. Such products may include one or more cigarettes, pipe tobacco, leaf chew, snuff, etc. If pipe tobacco is provided, a pipe (not shown) may be included within the combination package 10 as part of the tobacco product.

The inventive combination package 10 provides a user with a simple and economical means of enjoying a cigar with a drink, without wasting time and money purchasing the two separately, often at two different locations. A user may simply add ice and/or a mixer to the beverage (liquor) 12, if they so desire, and enjoy the cigar 16 with his/her drink.

Figure 2:
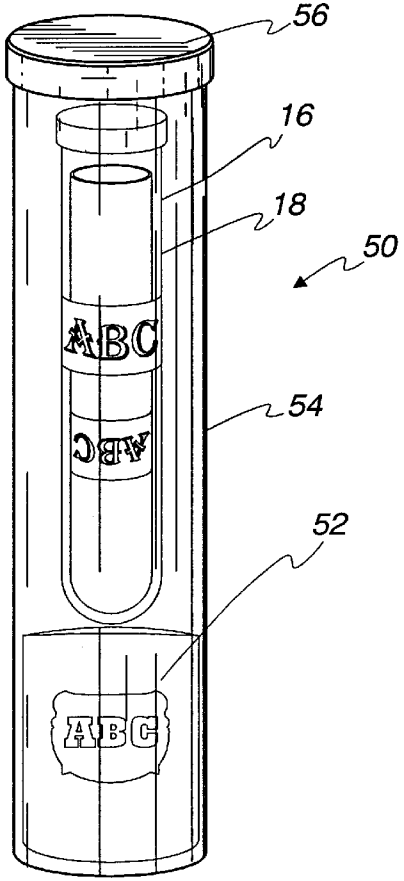
FIG. 2 is a front view of a tobacco combination pack according to a second embodiment of the present invention.

FIG. 2 illustrates a combination package according to a second embodiment of the present invention, shown generally at 50, with like elements of FIG. 1 indicated with the same reference numbers. In the combination package 50, the beverage 12 shown in FIG. 1 has been replaced with a generalized article 52. The article 52 may include virtually any type of article, novelty item or otherwise, which may be sold in conjunction with the cigar 16. Such articles may include, but are not limited to, golf balls, key chains, writing instruments, such as pens, pencils, markers, etc., cigar cutters, lighters, etc. In a preferred form, the article 52 is related to the cigar 16. For example, the article 52 may include indicia associating the article 52 with the cigar 16. For instance, if the cigar 16 is of the "ABC" brand, the article 52 may include the "ABC" trademark or logo stamped thereon. In another example, the cigar 16 may be marketed under a certain marketing theme employed by its manufacturer, with the article 52 associated with the marketing theme. For instance, if the cigar 16 is a Speakeasy™ brand cigar, the article 52 may be any article associated with the Speakeasy theme. It should be understood that while FIG. 2 illustrates a cigar 16 packaged with the article 52, other tobacco products may be substituted in place of the cigar 16 without departing from the spirit and scope of the present invention.

Both the cigar 16 and the article 52 are provided in a container 54 which is sized, depending on the identity of the article 52, to receive the cigar 16 and the article 52. The container 54 may be made of clear plastic or other transparent or non-transparent materials, and generally includes a lid 56 sealing the container 54. In the event the cigar 16 is not provided within the tobacco container 18, the lid 56 may form an airtight seal for the container 54.

Figure 3:
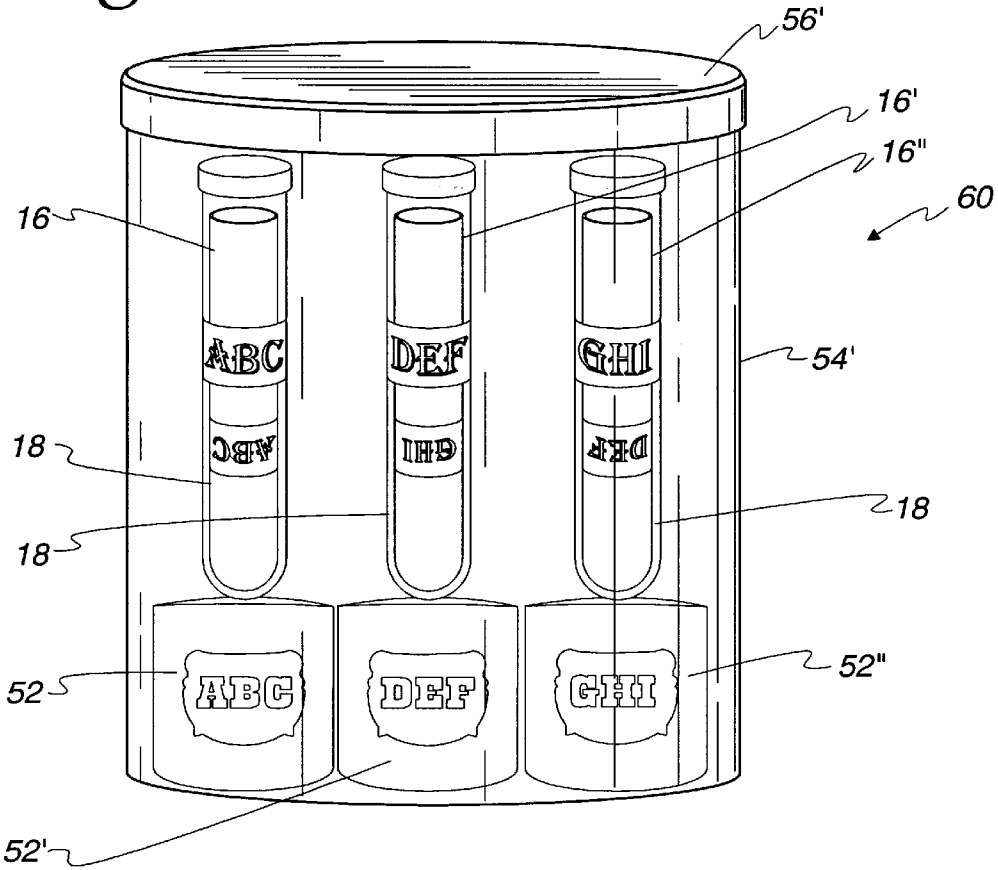
FIG. 3 is a front view of a tobacco combination pack according to a third embodiment of the present invention.

FIG. 3 illustrates a combination package according to a third embodiment of the present invention, shown generally at 60, with like elements of FIG. 2 indicated with the same reference numbers. The combination package 60 includes multiple cigars 16, 16', 16" and multiple articles 52, 52', 52" provided within a container 54' sealed by a lid 56'. The cigars 16, 16', 16" may be all the same brand or may be different brands made by the same cigar manufacturer. Similarly, the articles 52, 52', 52" may be the same or different. For example, as shown in FIG. 3, each of the cigars 16, 16', 16" is of a different brand made by the same cigar manufacturer (cigar 16—ABC), (cigar 16'—DEF), (cigar 16"—GHI). Similarly, each of the articles 52, 52', 52" includes indicia relating the article to a particular brand of cigar (article 52—ABC), (article 52'—DEF), (article 52"—GHI). In another example, each of the cigars 16, 16', 16" may be a different type of Speakeasy™ brand cigar, with each of the articles 52, 52', 52" being a different article associated with the Speakeasy theme. In a further example, each of the cigars 16, 16', 16" may be made by different cigar manufacturers with each of the articles 52, 52', 52" associated with each of the different cigar manufacturers. This last example would most likely be sold as a "sampler package" with each cigar manufacturer believing their cigar to be the best among the bunch.

In a preferred form, each of the cigars 16, 16', 16" and the articles 52, 52', 52" are provided in a one-to-one relationship, however, the combination package 60 may include one cigar 16 with multiple articles 52, multiple cigars 16 with one article 52, or any combination of cigars 16 and articles 52 therebetween. The container 54' is preferably sized to receive the desired plurality of cigars 16 and articles 52. Any or all of the articles 52, 52', 52" shown in FIG. 3 may be the beverage 12, within the container 14, as shown and described with respect to FIG. 1.

While the invention has been described with particular reference to the drawings, it should be understood that various modifications could be made without departing from the spirit and scope of the present invention.

What is claimed is:

1. A packaging system comprising:

an elongated, generally cylindrical, transparent, tubular first container having an access opening provided with a removable lid; and a stacked assembly within said first container and accessible therein when said lid is removed, said stacked assembly including a relatively small volume second container containing an alcoholic beverage stacked with an airtight, elongated third container containing a tobacco cigar.

2. The packaging system of claim 1 wherein said relatively small volume is a volume in the range of 20 to 100 mL.

3. The packaging system of claim 2 wherein said first container has a length in the range of approximately 12 inches to 14 inches, and a diameter in the range of approximately 1.25 inches to 1.75 inches.

4. A packaging system comprising:

an elongated transparent, tubular first container having an access opening provided with a removable lid; and a stacked assembly within said first container and accessible therein when said lid is removed, said stacked assembly including a relatively small volume second container containing an alcoholic beverage stacked with an elongated third container containing a tobacco cigar.

5. A packaging system comprising:

an elongated, generally cylindrical, tubular first container having an access opening provided with a removable lid; and a stacked assembly within said first container and accessible therein when said lid is removed, said stacked assembly including a relatively small volume second container containing an alcoholic beverage stacked with an elongated third container containing a tobacco cigar.

* * * * *